US009433946B2

(12) United States Patent
Kormann

(10) Patent No.: US 9,433,946 B2
(45) Date of Patent: Sep. 6, 2016

(54) MOBILE APPARATUS FOR COMMINUTING LUMPY MATERIAL

(71) Applicant: KORMANN ROCKSTER RECYCLER GMBH, Ennsdorf bei Enns (AT)

(72) Inventor: Wolfgang Kormann, Schwertberg (AT)

(73) Assignee: Kormann Rockster Recycler GmbH, Ennsdorf bei Enns (AT)

( * ) Notice: Subject to any disclaimer, the term of this patent is extended or adjusted under 35 U.S.C. 154(b) by 35 days.

(21) Appl. No.: 14/370,567

(22) PCT Filed: Jan. 4, 2013

(86) PCT No.: PCT/AT2013/050003
§ 371 (c)(1),
(2) Date: Jul. 3, 2014

(87) PCT Pub. No.: WO2013/102232
PCT Pub. Date: Jul. 11, 2013

(65) Prior Publication Data

US 2014/0367503 A1 Dec. 18, 2014

(30) Foreign Application Priority Data

Jan. 5, 2012 (AT) ..... GM50001/2012

(51) Int. Cl.
*B02C 23/12* (2006.01)
*B02C 21/02* (2006.01)
*B02C 23/02* (2006.01)

(52) U.S. Cl.
CPC ..... *B02C 23/12* (2013.01); *B02C 21/026* (2013.01); *B02C 23/02* (2013.01)

(58) Field of Classification Search
CPC ..... B02C 23/12; B02C 23/02; B02C 21/026
USPC ..... 241/101.7, 101.74, 101.741, 101.76
See application file for complete search history.

(56) References Cited

U.S. PATENT DOCUMENTS 6,877,610 B2 4/2005 Boast
2004/0061009 A1* 4/2004 Rosser, Jr. ..... B02C 1/005 241/101.76

FOREIGN PATENT DOCUMENTS

DE 197 15 889 A1 10/1998
DE 10105348 A1 8/2002

(Continued)

OTHER PUBLICATIONS

International Search Report of PCT/AT2013/050003, mailed Jul. 15, 2013.

(Continued)

*Primary Examiner* — Mark Rosenbaum
(74) *Attorney, Agent, or Firm* — Collard & Roe, P.C.

(57) ABSTRACT

A mobile apparatus for comminuting lumpy material, especially rock, includes a chassis, a crusher arranged on the chassis, a feed device, provided on the chassis, for the lumpy material to be fed to the crusher and comminuted, a removal conveying device having a sieve device for the material comminuted by the crusher and a return conveying device for returning material held back by the sieve device to the feed device. In order to ensure heap separation of comminuted material of different grain sizes despite high crushing throughput, one conveying section of the return conveying device including at least two conveying sections is secured to the device by at least one rotational joint such that it can be turned away from the feed device.

9 Claims, 2 Drawing Sheets

(56) References Cited

FOREIGN PATENT DOCUMENTS

| | | | |
|---|---|---|---|
| DE | 103 05 589 | A1 | 8/2003 |
| EP | 0306730 | A2 | 3/1989 |
| EP | 1 166 880 | A2 | 1/2002 |
| JP | 6-254429 | A | 9/1994 |
| JP | H0796210 | A | 4/1995 |
| WO | 2005/099903 | A1 | 10/2005 |
| WO | 2008/129287 | A2 | 10/2008 |

OTHER PUBLICATIONS

Austrian Search Report in GM 50001/2012 dated Dec. 28, 2012, with English translation of relevant parts.

Screenshot of video of apparatus C-1540RS from Terex Finlay, video is accessible at https://www.youtube.com/watch?v=Wri3oF7BPi0, published on Nov. 3, 2010.

Screenshot of video of apparatus Mobirex 130 from Kleemann GmbH, video is accessible at https://www.youtube.com/watch?v=Nizp6NstlWk, published on Dec. 7, 2011, Kleemann GmbH is located at 73037 Goeppingen in Germany.

Screenshot of video of apparatus Mobirex 110 from Kleemann, video is accessible at https://www.youtube.com/watch?v=J0-YNFIlfp8, published on Mar. 30, 2011.

"Neue Prallbrecher-Generation im Härtetest", VDBUM, Aug. 20, 2010, p. 14, 4th issue of 2010, vol. 38, ISSN-No. 0940-3035, Weyhe, Germany.

Pictures of the device Mobirex 130 from Kleemann, publication date unknown, year of construction 2010, cited in European Opposition on Apr. 7, 2016.

Pictures of the device C-1540RS from Terex Finlay, publication date unknown, cited in European Opposition on Apr. 7, 2016, Terex Germany GmbH & Co KG is located at D-40597 Duesseldorf.

More pictures of the device Mobirex 130 from Kleemann, publication date unknown, year of construction 2010, cited in European Opposition on Apr. 7, 2016.

English Translation of the Written Opinion of the International Searching Authority of PCT/AT2013/050003, mailed Jul. 5, 2014.

* cited by examiner

MOBILE APPARATUS FOR COMMINUTING LUMPY MATERIAL

CROSS REFERENCE TO RELATED APPLICATIONS

This application is the National Stage of PCT/AT2013/050003 filed on Jan. 4, 2013, which claims priority under 35 U.S.C. §119 of Austrian Application No. GM 50001/2012 filed on Jan. 5, 2012, the disclosure of which is incorporated by reference. The international application under PCT article 21(2) was not published in English.

TECHNICAL FIELD

The invention relates to a mobile apparatus for comminution of chunk material, particularly of rocks, having a chassis, having a crusher disposed on the chassis, having a charging device provided on the chassis for the material to be fed to the crusher and to be comminuted, having a removal conveying device with a screening device for the material comminuted by the crusher, and having a return conveying device for return of the material retained by the screening device to the charging device.

STATE OF THE ART

From the state of the art, embodiments of an apparatus having return conveying devices are known, which make it possible to return a material comminuted by a crusher and picked up by a removal conveying device to the crusher, for the purpose of its renewed processing, if this material was not yet comminuted to the desired grain size. Such return conveying devices have a conveying section having a conveyor belt that passes through them, with which the material that is too coarse and was retained by the screening device can be transported away. Furthermore, these return conveying devices can be adjusted, in terms of their position relative to the charging device of the crusher, in order to prevent possible hindrance in charging the crusher with new material, for example. In the event that not only screened, comparatively fine material, but also coarsely comminuted material is conveyed by such an apparatus, the return conveying device can be circumvented, and the screened, coarse material can be thrown onto a pile next to the screening device. However, this proves to be relatively complicated, because in order to avoid mixing of the piles, these must be spaced apart from one another, accordingly. Furthermore, the restricted height adjustability of the removal conveying device is disadvantageous, and for this reason, the possible pile height of the screened material is limited. It is true that the mobility of the apparatus could be used to increase the possible pile height, but because of its size, the weight that must be moved for this purpose and/or also because of an interruption of operation that might be required, this is comparatively complicated and time-intensive. For this reason, great production output cannot be achieved with this apparatus, particularly if comminuted material that is separated into grain sizes is supposed to be produced.

PRESENTATION OF THE INVENTION

It is therefore the task of the invention to improve a mobile apparatus of the type described initially, in simple manner in terms of design, in such a manner that despite great crushing output, pile separation of comminuted material with different grain sizes can be ensured.

The invention accomplishes the stated task in that a conveying section of the return conveying device having at least two conveying sections is fastened onto the apparatus by way of at least one rotational joint, so that it can be turned away from the charging device.

If a conveying section of the return conveying device having at least two conveying sections is fastened onto the apparatus by way of at least one rotational joint, so that it can be turned away from the charging device, then great crushing output can be ensured without significant additional effort on the apparatus, in terms of design. Specifically, it is not only possible to convey a material to be transported by the return conveying device to the charging device, but also away from the apparatus and, for example, to place it in a separate pile away from the apparatus. In this way, a pile consisting of a mixture of comminuted material with different grain sizes can be avoided in simple manner. Instead, it is actually possible to separate material into grain size ranges—in a single work step—and to deposit it onto separate piles. Using multiple conveying sections, conveyed material can furthermore be flexibly transported. In contrast to conveying devices that have only one conveying section, the transport path can be adapted extremely flexibly—for example to the local conditions or other requirements. This also plays a significant role particularly if piles with oversize grain are supposed to be built up in the surroundings of the apparatus, without the risk of mixing with other material. Furthermore, a return conveying device divided into sections can offer the advantage of making lower design demands on joint and drive, and thereby a stable apparatus can be made possible even under comparatively great stress. In general, it should be mentioned that turning away can be understood to mean the ability to turn, particularly about an axis of rotation that is inclined relative to the longitudinal axis of the chassis. Preferably, two rotational joints have proven to be sufficient for mounting a conveying section. Therefore, it can be decisive that the end of the conveying section can be turned away from the charging device.

In order to be able to build up comparatively high piles, it can be provided that the conveying section that opens into the charging device is configured so that it can be turned away from the charging device.

Design simplicity can be achieved if the rotational joint has a pin. Such pin connections can also lead to a robust apparatus, because of their great ability to withstand stress.

A particularly robust apparatus can be created if the conveying section of the return conveying device that can be turned away is mounted on the chassis. Specifically, it is possible to use the design of a chassis to configure the mounting of the return conveying device in particularly stable manner. In this way, an increased radius of rotation of the conveying section of the return conveying device that can be turned away can subsequently be created, and this leads to advantages not only with regard to the variable usability of the apparatus, but also with regard to the shaping of a charging device and/or the structure of an apparatus.

If the conveying section of the return conveying device that can be turned away is mounted on the chassis by way of a V-shaped support, not only design simplicity but also a further improvement with regard to the robustness of an apparatus can result. Specifically, a V-shaped support can be designed in comparatively simple and robust manner, so that it can be used not only for turning the section away but also for changing the angle of elevation of the return conveying device. Thus, a support of a return conveying device designed in this manner can be operated in reliable manner even at a comparatively large charge of conveyed material.

If the conveying section of the return conveying device that can be turned away is structured so that it can be pivoted in terms of its inclination, particularly versatile usability can be ensured. Because, in addition, the angle of elevation of the return conveying device is also adjustable, this angle can be adapted accordingly to the degree of filling of a charging device or to the height of a pile.

It can prove to be particularly advantageous—particularly with regard to the possible conveyed amount and conveying speed—if sections of the return conveying device are configured, at least in part, as a conveyor belt. Depending on the use or the type of conveyed material of the return conveying device, the profiling of a belt can furthermore also be varied. In particularly for those sections of the return conveying device that have a high angle of elevation, conveyor belts that have ribs, for example, can be used.

Simplified design conditions can occur if the conveying section that can be turned away is configured as a discharge conveyor belt.

BRIEF DESCRIPTION OF THE DRAWING

In the figures, the object of the invention is shown as an example, using a first exemplary embodiment. The drawing shows.

WAY TO IMPLEMENT THE INVENTION

Figure 1:
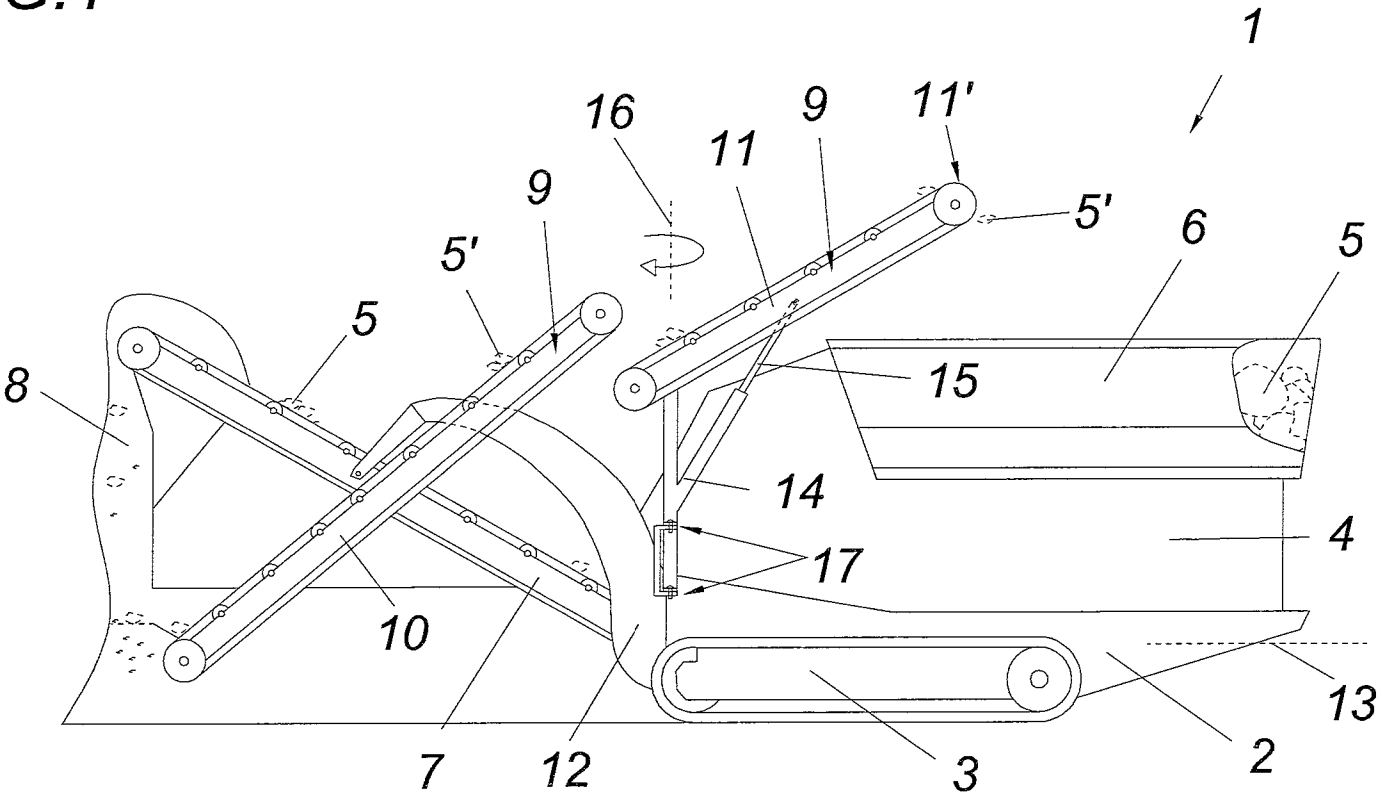
FIG. 1 a schematic side view of an apparatus for comminution of chunk material, and FIG. 2 an enlarged and cut-away side view of FIG. 1.

The mobile apparatus 1 shown in a simplified side view according to FIG. 1, for example, has a chassis 2 with a caterpillar mechanism 3. In order to feed chunk material 5, primarily rocks, to the crusher 4 of the apparatus disposed on the chassis 2, a charging device 6 is provided on the chassis 2. The material 5 comminuted by the crusher 4 is conveyed away from the crusher 4 using a removal conveying device 7 connected with the holding part 12 of the chassis 2. The removal conveying device 7 has a screening device 8 for separating oversize grain 5', in other words the material that lies above a desired or tolerated size, to be passed to a return conveying device 9. According to the invention, this return conveying device 9 has two conveying sections 10, 11, which can be used to transport oversize grain 5' back to the charging device, for the purpose of renewed processing by the crusher 4. The return conveying device 9 can—if desired or required—of course also consist of more than two conveying sections. The conveying section 11 disposed last is mounted so that it can be turned away from the charging device 6, which rotatability is made possible by means of two rotational joints 17 and permits a movement of the conveying section 11 about the axis of rotation 16 that stands perpendicular to the longitudinal axis 13 of the chassis. In this way, the end 11' of the conveying section 11 can be turned away from the charging device 6. Therefore it is not only possible to feed the oversize grain 5' conveyed by the return conveying device 9 to the charging device 6, but also—by turning the conveying section 11 away from the charging device 6—to drop it onto a pile next to the apparatus. Of course, it is also possible to drop the oversize grain 5' onto a further conveying device instead of onto a pile, or to pass it to another apparatus. In this way, variable use possibilities of the apparatus 1 can be guaranteed.

Figure 2:
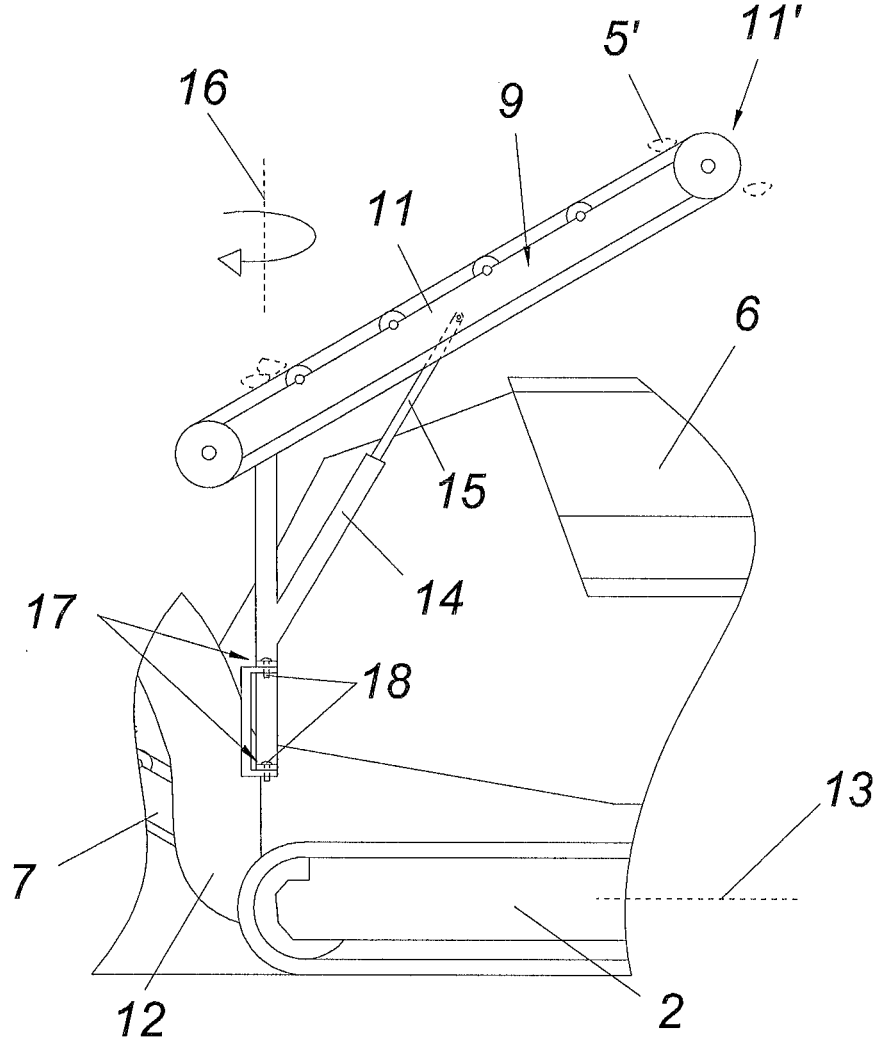

In a simple design, the rotational joints 17 are formed by pin connections, as can be particularly seen in FIG. 2. The pins 18 for the rotational joints 17 have proven to be able to withstand comparatively great stress and to be vibration-resistant, and this is particularly advantageous for an apparatus 1 for comminution of chunk material 5.

A return conveying device has proven to be particularly robust if the conveying section 11 of the return conveying device 9 is mounted on the chassis 2, as shown in the figure.

The conveying section 11 is mounted on the chassis 2 of the apparatus 1 by way of a V-shaped support 14, thereby further improving the robustness of the return conveying device 9. The V-shaped support 14 is also characterized in that the devices for rotatability and inclination adjustability of the conveying section 11 can be provided on it in particularly simple manner.

The conveying section 11 is structured so that it can be pivoted in terms of its inclination, using a hydraulic device 15, particularly a hydraulic cylinder, thereby making it possible to adapt the angle of elevation of this conveying section to the degree of filling of the charging device or, for example, also to the height of a pile—in the position turned away from the charging device 6.

In the exemplary embodiment, the return conveying device 9 is configured as a conveyor belt, and this is an advantage with regard to continuous and reliable transport of conveyed material. The design embodiment as a discharge conveyor belt furthermore leads to simple design conditions at the apparatus 1.

The invention claimed is:

1. Mobile apparatus for comminution of chunk material, the mobile apparatus comprising:

a chassis, a crusher, a charging device for the material to be fed to the crusher and to be comminuted, a removal conveying device with a screening device for the material comminuted by the crusher, and a return conveying device for return of the material retained by the screening device to the charging device, the return conveying device being divided into a first return conveying section and a second return conveying section, each of the first return conveying section and the second return conveying section being oriented in a direction of the charging device, wherein the second return conveying section is fastened onto the apparatus by way of at least one rotational joint, so that the second return conveying section can be turned away from the charging device.

2. Mobile apparatus according to claim 1, wherein the second return conveying section opens into the charging device.

3. Mobile apparatus according to claim 1, wherein the rotational joint has a pin.

4. Mobile apparatus according to claim 1, wherein the second return conveying section is mounted on the chassis.

5. Mobile apparatus according to claim 1, wherein the second return conveying section is mounted on the chassis by way of a V-shaped support.

6. Mobile apparatus according to claim 1, wherein the second return conveying section is structured so that it can be pivoted in terms of its inclination.

7. Mobile apparatus according to claim 1, wherein the first return conveying section is configured, at least in part, as a first conveyor belt, and wherein the second return conveying section is configured at least in part, as a second conveyor belt.

8. Mobile apparatus according to claim 1, wherein the second return conveying section is configured as a discharge conveyor belt.

9. Mobile apparatus according to claim 1, wherein the first return conveying section has a first angle of elevation, and wherein the second return conveying section has a second angle of elevation.

* * * * *